US008116494B2

(12) United States Patent
Rass

(10) Patent No.: US 8,116,494 B2
(45) Date of Patent: Feb. 14, 2012

(54) METHOD FOR GENERATING AN ACOUSTIC SIGNAL OR FOR TRANSMITTING ENERGY IN AN AUDITORY CANAL AND CORRESPONDING HEARING APPARATUS

(75) Inventor: Uwe Rass, Nümberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1302 days.

(21) Appl. No.: 11/805,012

(22) Filed: May 22, 2007

(65) Prior Publication Data

US 2007/0274553 A1 Nov. 29, 2007

(30) Foreign Application Priority Data

May 24, 2006 (DE) ..... 10 2006 024 411

(51) Int. Cl.
*H04R 25/00* (2006.01)

(52) U.S. Cl. ..... 381/328; 381/323

(58) Field of Classification Search ..... 380/323, 380/322, 328, 380
See application file for complete search history.

(56) References Cited

U.S. PATENT DOCUMENTS

| | | | | |
|---|---|---|---|---|
| 5,220,918 | A | 6/1993 | Heide et al. | |
| 5,701,348 | A | 12/1997 | Shennib et al. | |
| 5,721,783 | A * | 2/1998 | Anderson | 381/328 |
| 6,387,039 | B1 | 5/2002 | Moses | |
| 6,438,245 | B1 * | 8/2002 | Taenzer et al. | 381/330 |
| 7,016,511 | B1 | 3/2006 | Shennib | |
| 7,227,968 | B2 * | 6/2007 | van Halteren et al. | 381/328 |
| 7,606,382 | B2 * | 10/2009 | Feeley et al. | 381/330 |
| 2002/0191806 | A1 * | 12/2002 | Rohrseitz et al. | 381/323 |
| 2006/0189841 | A1 | 8/2006 | Pluvinage | |

FOREIGN PATENT DOCUMENTS

| | | | |
|---|---|---|---|
| DE | 35 08 830 | A1 | 9/1986 |
| DE | 38 26 294 | A1 | 2/1990 |
| DE | 10 2004 050 616 | B3 | 3/2006 |
| WO | 0158206 | A2 | 8/2001 |
| WO | 2006042298 | A2 | 4/2006 |

* cited by examiner

*Primary Examiner* — Davetta W Goins
*Assistant Examiner* — Phan Le

(57) ABSTRACT

Changing batteries in hearing apparatuses worn in the auditory canal is to be designed in a more user-friendly manner. To this end, a hearing apparatus is provided with a first component which can be worn in the auditory canal, said component comprising a receiver unit for the wireless reception of signals. The hearing apparatus also exhibits a second component which is separated from the first component in terms of design, said second component likewise being able to be worn in the auditory canal and a transmitter unit for the wireless transmission of signals and/or energy to the receiver unit of the first component. The first component can be designed to be battery-less. The second component, which is positioned further outside in the auditory canal, can be easily removed from the auditory canal in order to change the battery.

17 Claims, 1 Drawing Sheet

METHOD FOR GENERATING AN ACOUSTIC SIGNAL OR FOR TRANSMITTING ENERGY IN AN AUDITORY CANAL AND CORRESPONDING HEARING APPARATUS

CROSS REFERENCE TO RELATED APPLICATIONS

This application claims priority of German application No. 10 2006 024 411.7 DE filed May 24, 2006, which is incorporated by reference herein in its entirety.

FIELD OF INVENTION

The present invention relates to a hearing apparatus having a component which can be worn in the auditory canal, said component having a receiver unit for the wireless reception of signals. Furthermore, the present invention relates to a method for generating an acoustic signal or for transmitting energy in an auditory canal. In particular, the invention relates to hearing devices which are arranged in the ear canal.

BACKGROUND OF INVENTION

Hearing devices which are positioned deep within the ear canal, so-called CICs (completely in the canal) are problematic for a number of reasons. On the one hand, the user finds pushing the device so far into the ear canal unpleasant. Furthermore, the risk exists of the eardrum or the sensitive skin in the bony region of the ear canal being touched or damaged. Hearing devices which are completely accommodated in the ear canal must consequently be removed from time to time to change the battery and reinserted.

The insertion of CICs which are positioned deep within the ear canal is typically carried out by a hearing device acoustician or an otologist. This means that each time the battery is changed, the doctor and/or acoustician needs to be found. An alternative to this would consist at best of using CICs which are positioned less deeply, and which can be removed from the ear canal by the user him/herself. Devices of this type are however inefficient, by virtue of the large residual volume between the hearing device and eardrum, and produce potentially interfering occlusion effects.

The publication DE 10 2004 050 616 B3 discloses a hearing aid having signal coupling. The hearing aid is equipped with a first component which is positioned in the auditory canal. A second component, with which signals can be received from the first, is arranged outside the auditory canal.

Furthermore, the publication DE 38 26 294 A1 discloses a hands-free device for communication systems. A reproducer is worn in an ear. It receives its signals from a transmitter arranged outside the ear by way of a wireless transmission path.

A hearing device is also described in the publication DE 35 08 830 A1, with which the receiver is located outside the hearing device housing in an otoplastic. The amplifier of the hearing device and the receiver are connected wirelessly.

Finally, a hearing apparatus having two components is known from the publication U.S. Pat. No. 5,701,348 A, with which the two components are arranged in the auditory canal. The two components are permanently coupled with one another with a link.

SUMMARY OF INVENTION

An object of the present invention thus consists in proposing a hearing apparatus which is positioned deep within the ear canal, with which a change of battery can be carried out by the user in a more user-friendly manner.

In accordance with the invention, this object is achieved by a hearing apparatus having a first component which can be worn in the auditory canal, said component comprising a receiver unit for the wireless reception of signals, and having a second component which is separated from the first component in terms of design, said second component likewise being able to be worn in the auditory canal and having a transmitter unit for the wireless transmission of signals and/or of energy to the receiver unit of the first component.

Furthermore, provision is made in accordance with the invention for a method for generating an acoustic signal or for transmitting energy in an auditory canal by generating a wirelessly transmittable signal in the auditory canal through a second component, receiving the wirelessly transmitted signal further in the interior of the auditory canal through a first component and converting the received signal through the first component into an acoustic signal and/or using the energy transmitted in the received signal.

In accordance with the invention, the concept of arranging a component, which itself exhibits no storage device, deep within the auditory canal and of transmitting the signals and/or energy wirelessly to this component, is thus utilized. A further component which is located outside the auditory canal transmits the signal or as applicable the energy to the more deeply positioned component. The more deeply positioned component must only be removed very rarely, whereas the component positioned on the outside can be easily removed by the user in order to change the battery for instance.

The hearing apparatus is preferably designed as a hearing device. CIC devices in particular can thus profit from the advantage according to the invention.

The second component can exhibit a seal for the soundproof position in the auditory canal. The efficiency of the sound transmission from the second component to the eardrum is herewith improved.

Furthermore, the second component can comprise a receiver coil. This means that signals or as applicable energy can be inductively transmitted to the second component. The second component then also has an electromechanical converter for converting the signals into acoustic waves.

Alternatively, the second component can comprise a magnetically active membrane. This is preferably coated with a ferromagnetic liquid. The membrane for generating sound can be moved with the aid of a magnet disposed in the auditory canal.

In the simplest configuration, the second component exclusively consists of the magnetically active membrane and the seal or another passive fastener for fixing the membrane in the auditory canal. A loudspeaker can herewith be conveniently realized, whereby the auditory canal wall represents the loudspeaker housing.

BRIEF DESCRIPTION OF THE DRAWINGS

The present invention is now described in more detail with reference to the appended drawings, in which.

The embodiments illustrated in more detail below represent preferred exemplary embodiments of the present invention.

DETAILED DESCRIPTION OF INVENTION

Figure 1:
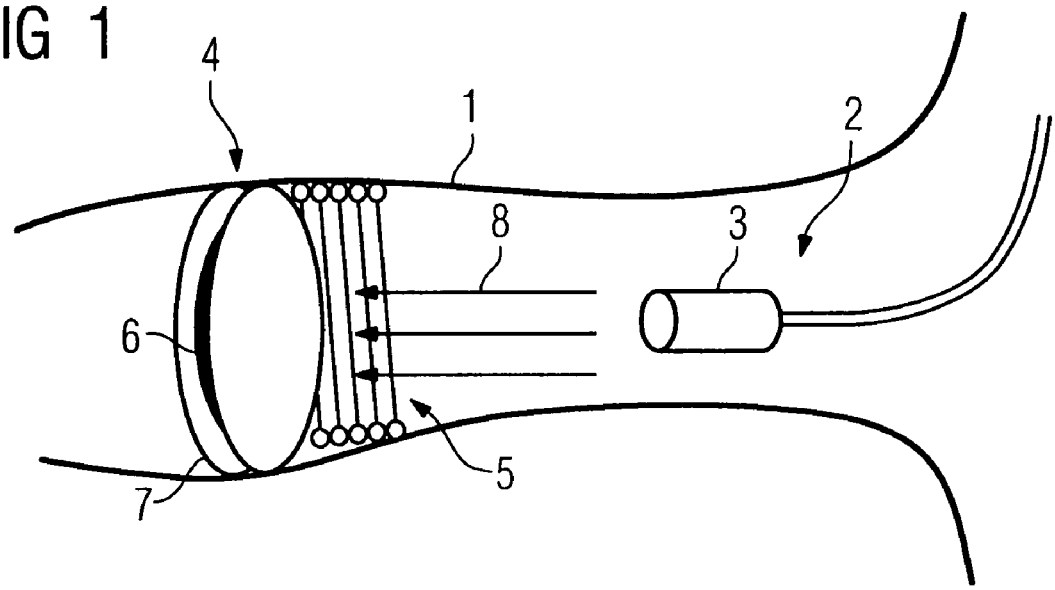
FIG. 1 shows a hearing apparatus according to a first embodiment having a receiver coil and FIG. 2 shows a hearing apparatus according to a second embodiment having a magnetic membrane.

According to FIG. 1, a hearing device which is divided into two parts in terms of design is inserted in an ear canal and/or auditory canal 1. A second component 2 is used to generate a signal in the auditory canal 1. In the example in FIG. 1, the second component 2 comprises a transmitter coil 3 which is arranged in the auditory canal 1, said transmitter coil 3 being connected to a signal processor which is external to the auditory canal (not shown in FIG. 1), to microphones and to a battery. Alternatively, the overall signal processor including microphone, battery and transmitter coil can also be arranged in the ear canal or partially in the ear canal.

A first component 4 of the hearing device is also disposed in the interior of the ear canal 1. Said first component 4 consists here of a receiver coil 5, an electro-acoustic converter 6 and a seal 7 and if necessary additional electronics systems. The second first component 4 is battery-less and converts the signals received with the aid of the coil 5 and if necessary further processed by the signal processor into acoustic signals for direct reception through the eardrum (not shown in FIG. 1).

The transmitter coil 3 of the second component 2 transmits the output signal and if necessary energy for the signal processor in magnetic form to the second component 4 which is positioned deep within the ear. FIG. 1 symbolically shows the supply to the electronics system for the signal processor and the receiver or as applicable sound converter 6 via a magnetic field by means of arrows 8.

Figure 2:
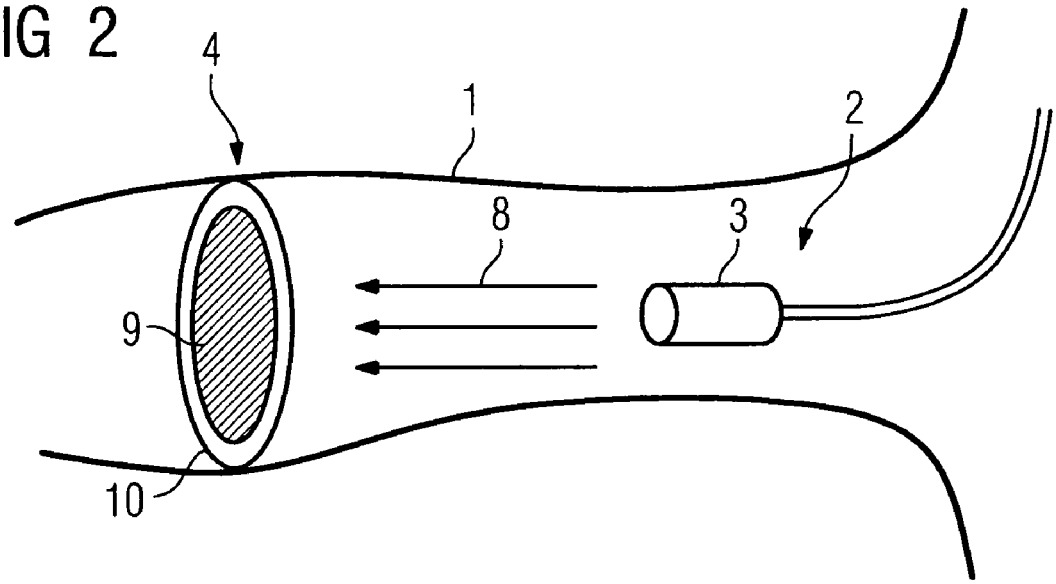

The embodiment of a hearing apparatus according to the invention reproduced in FIG. 2 has an even simpler design than the embodiment in FIG. 1. The second component 2 consists here inter alia, as in the first embodiment, of a transmitter coil 3, which is disposed in the auditory canal 1. Said transmitter coil interacts magnetically (arrow 8) with the first component 4, which is arranged deeper in the auditory canal. This first component 4 only consists here of a magnetically active membrane 9, which is held in the ear canal 1 with the aid of a fastener and/or seal 10.

The magnetically active membrane 9 exhibits a ferromagnetic coating, which enables the membrane to move with the aid of the magnetic field, which is generated by the first component 2. The membrane is preferably coated with a ferromagnetic liquid, which dries after application.

As the second component 4 consists here exclusively of the passive membrane 9, aside from the seal 10, a signal coding during the signal transmission between the two components 2 and 4 is not possible. On the other hand, with the first embodiment according to FIG. 1, an electronics system used in some circumstances enables a coding during the signal transmission within the auditory canal.

The hearing devices illustrated in detail above exhibit numerous advantages. On the one hand, the first component 4 and/or its seal 7, 10 can remain permanently in the ear canal 1 so that the otologist only needs to position it once for instance. This herewith enables the first component 4 to be battery-less. Furthermore, the deep position of the first component enables an effective acoustic supply, in particular a high output level with relatively minimal energy usage.

Furthermore, the transmitter coil 3 of the second component can be applied extensively along the ear canal 1, thereby resulting in a more effective magnetic field coupling. The second component 2 can also be a hearing device for instance, said hearing device not being adapted individually to a wearer and the earpiece of which does not have to be adapted individually (so-called open BTE hearing device). The acoustically unproblematic positioning of a transmitter coil in the auditory canal is instead sufficient here to generate a magnetic field. A completely open, occlusion-free coupling to the ear canal 1 is thus possible. The advantages of a user-friendly open BTE hearing device are thus combined with the good sound quality of the deeply positioned CICs.

The invention claimed is:

1. A hearing apparatus comprising:

a first component to be worn in an auditory canal, wherein the first component has a receiver unit for a wireless reception of an electromagnetic signal; and a second component separated from the first component, wherein the second component has a transmitter unit for a wireless transmission of the signal to the receiver unit, wherein the transmitter unit is configured so that the electromagnetic signal is effective to transmit signal information and is further effective to transmit a sufficient amount of electrical power to electrically power circuitry in the first component.

2. A hearing apparatus as claimed in claim 1, wherein the second component is worn in the auditory canal.

3. The hearing apparatus as claimed in claim 1, wherein the hearing apparatus is a hearing device.

4. The hearing apparatus as claimed in claim 1, wherein the first component has a seal for a soundproof positioning in the auditory canal.

5. The hearing apparatus as claimed in claim 1, wherein the first component has a receiver coil.

6. The hearing apparatus as claimed in claim 2, wherein the first component has a magnetically active membrane.

7. The hearing apparatus as claimed in claim 6, wherein the membrane is coated with a ferromagnetic liquid.

8. The hearing apparatus as claimed in claim 6, wherein the first component consists of the magnetically active membrane and a passive fastener.

9. The hearing apparatus as claimed in claim 8, wherein the passive fastener is the seal.

10. The hearing apparatus as claimed in claim 2, wherein the second component is removeable from the auditory canal separately from the first component.

11. A method for generating an acoustic signal in an auditory canal, comprising:

generating a wirelessly transmittable electromagnetic signal in the auditory canal via a second component;

receiving the wirelessly transmitted signal further within the auditory canal via a first component;

transmitting signal information by way of the electromagnetic signal;

transmitting by way of the electromagnetic signal a sufficient amount of electrical power to electrically power circuitry in the first component; and converting the received signal information via the first component into an acoustic signal.

12. The method as claimed in claim 11, wherein a space in the auditory canal between the first component and an eardrum is sealed in a soundproof manner.

13. The method as claimed in claim 11, wherein the signal is transmitted based upon induction.

14. The method as claimed in claim 11, wherein the first component has no energy storage device.

15. A method for transmitting energy in an auditory canal, comprising:

generating a wirelessly transmittable electromagnetic signal in the auditory canal based upon a second component;

receiving the wirelessly transmitted signal further within the auditory canal based upon a first component;

transmitting signal information by way of the electromagnetic signal; and transmitting by way of the electromagnetic signal a sufficient amount of electrical power to electrically power circuitry in the first component.

16. The method as claimed in claim 15, wherein a space in the auditory canal between the first component and an eardrum is sealed in a soundproof manner.

17. The method as claimed in claim 16, wherein the first component has no energy storage device.

* * * * *